US006926120B1

(12) United States Patent
Bradley

(10) Patent No.: US 6,926,120 B1
(45) Date of Patent: Aug. 9, 2005

(54) MASONRY PROJECT KIT

(76) Inventor: Charles A. Bradley, 1491 Coppins Rd., Gaylord, MI (US) 49735

( * ) Notice: Subject to any disclaimer, the term of this patent is extended or adjusted under 35 U.S.C. 154(b) by 39 days.

(21) Appl. No.: 10/295,240

(22) Filed: Nov. 15, 2002

(51) Int. Cl.[7] ..... B66C 23/00
(52) U.S. Cl. ..... 182/82; 182/129; 212/179
(58) Field of Search ..... 182/129, 82, 150, 182/206, 151; 212/176, 179, 180

(56) References Cited

U.S. PATENT DOCUMENTS 230,459 A * 7/1880 Baker ..... 182/206
459,583 A * 9/1891 Johnson
3,902,700 A * 9/1975 Cox ..... 182/102
3,978,989 A * 9/1976 Avila, Jr. ..... 212/176
4,709,783 A * 12/1987 Tomioka et al. ..... 182/8
4,762,200 A * 8/1988 Andrews et al. ..... 182/151
5,311,966 A * 5/1994 Daniels ..... 182/128
5,445,281 A * 8/1995 Hung ..... 212/179
5,797,504 A * 8/1998 Mangum ..... 212/303
6,095,349 A * 8/2000 O'Meara ..... 212/180
6,135,300 A * 10/2000 Fox ..... 212/179

* cited by examiner

*Primary Examiner*—Alvin Chin-Shue

(57) ABSTRACT

Masonry project kits assist with building basements. In the course of building a basement, it is frequently necessary to climb over and lift equipment over walls. A wall hanger is provided to attach a ladder to the side of a wall. The ladder's height can be adjusted by changing which rungs are hung on the wall hanger. A platform at the base of the ladder allows the floor of a basement to be finished without leaving footprints. A hoist is also included for lifting loads into and out of a basement or over a wall. The hoist securely mounts to the corner of a wall. Both the wall hanger and the hoist accommodate a variety of wall widths.

15 Claims, 6 Drawing Sheets

MASONRY PROJECT KIT

BACKGROUND OF THE INVENTION

1. Field of the Invention

The present invention relates to a masonry project kit for use in connection with construction. The masonry project kit has particular utility in connection with building basements.

2. Description of the Prior Art

Masonry project kits are desirable for building basements. In the course of building a basement, it is frequently necessary to climb over and lift equipment over walls. It is also desirable to be able to access the floor of a basement without standing on it so that footprints will not be created. Masonry project kits provide a convenient mechanism for climbing walls and hoisting objects over walls. Furthermore, a platform attached to the ladder portion of the masonry project kit allows the user to finish a floor without contacting it with their feet. The hoist portion of the masonry project kit allows one or two people to lift equipment, such as a power trowel, easily.

The use of portable, collapsible hoist apparatuses is known in the prior art. For example, U.S. Pat. No. 5,265,742 to Stenger et al. discloses a portable, collapsible hoist apparatus. However, the Stenger et al. '742 patent does not have a V-shaped wall support, and has further drawbacks of lacking a base shaped like two rectangles perpendicular to one another with one overlapping corner.

U.S. Pat. No. 6,135,300 to Fox discloses a parapet-mounted hoist that is made from an elongated cradle. However, the Fox '300 patent does not have a V-shaped wall support, and additionally does not have a base shaped like two rectangles perpendicular to one another with one overlapping corner.

Similarly, U.S. Pat. No. 3,978,989 to Avila, Jr. discloses an extensible and collapsible portable derrick that can be disassembled and arranged in compact units. However, the Avila, Jr. '989 patent does not have a V-shaped wall support, and does not have a base shaped like two rectangles perpendicular to one another with one overlapping corner.

In addition, U.S. Pat. No. Des. 391,034 to Fukutomi discloses a roof car. However, the Fukutomi '034 patent does not have a V-shaped wall support, and also does not have a base shaped like two rectangles perpendicular to one another with one overlapping corner.

Furthermore, U.S. Pat. No. 4,621,741 to Boon discloses a readily disassembleable portable roof hoist mounted on the roof of a building for lifting heavy products to the roof from below that has a winch drum driven by a hydraulic motor. However, the Boon '741 patent does not have a V-shaped wall support, and further lacks a base shaped like two rectangles perpendicular to one another with one overlapping corner.

Lastly, U.S. Pat. No. 4,442,920 to Gronbeck et al. discloses a collapsible ladder that includes a plurality of platforms suspended from several rope segments. However, the Gronbeck et al. '920 patent does not have a hingedly attached platform, and has the additional deficiency of lacking a wall hanger.

While the above-described devices fulfill their respective, particular objectives and requirements, the aforementioned patents do not describe a masonry project kit that allows building basements. The Stenger et al. '742 patent, the Fox '300 patent, the Avila, Jr. '989 patent, the Fukutomi '034 patent, and the Boon '741 patent make no provision for a V-shaped wall support or a base shaped like two rectangles perpendicular to one another with one overlapping corner.

The Gronbeck et al. '920 patent does not have a hingedly attached platform, and has the additional deficiency of lacking a wall hanger.

Therefore, a need exists for a new and improved masonry project kit that can be used for building basements. In this regard, the present invention substantially fulfills this need. In this respect, the masonry project kit according to the present invention substantially departs from the conventional concepts and designs of the prior art, and in doing so provides an apparatus primarily developed for the purpose of building basements.

SUMMARY OF THE INVENTION

In view of the foregoing disadvantages inherent in the known types of portable, collapsible hoist apparatuses now present in the prior art, the present invention provides an improved masonry project kit, and overcomes the above-mentioned disadvantages and drawbacks of the prior art. As such, the general purpose of the present invention, which will be described subsequently in greater detail, is to provide a new and improved masonry project kit and method which has all the advantages of the prior art mentioned heretofore and many novel features that result in a masonry project kit which is not anticipated, rendered obvious, suggested, or even implied by the prior art, either alone or in any combination thereof.

To attain this, the present invention essentially comprises a ladder with an attached wall hanger and a hoist.

There has thus been outlined, rather broadly, the more important features of the invention in order that the detailed description thereof that follows may be better understood and in order that the present contribution to the art may be better appreciated.

The invention may also include the ladder having a hingedly attached platform and a support brace at one end. The wall hanger may have ladder brackets and a rear hanger brace. The hoist may have a winch, a lifting cable, a pulley, a clip, and a retaining ring. The winch may have a slidably mounted wall support adjuster with attached wall support. The hoist may have a first hoist tube rotatably inserted into a hoist tube fitting. The hoist may have a base shaped like two rectangles perpendicular to one another with one overlapping corner. The wall support adjuster may have a wall support adjuster stop threadedly inserted into a wall support adjuster stop hole. The ladder, wall hanger, and base may be made of steel, plastic, aluminum, titanium, or carbon fiber composite. The lifting cable may be made of rope, wire, cable, or chain. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved masonry project kit that has all of the advantages of the prior art portable, collapsible hoist apparatuses and none of the disadvantages.

It is another object of the present invention to provide a new and improved masonry project kit that may be easily and efficiently manufactured and marketed.

An even further object of the present invention is to provide a new and improved masonry project kit that has a low cost of manufacture with regard to both materials and labor, and which accordingly is then susceptible of low prices of sale to the consuming public, thereby making such masonry project kit economically available to the buying public.

Still another object of the present invention is to provide a new masonry project kit that provides in the apparatuses and methods of the prior art some of the advantages thereof, while simultaneously overcoming some of the disadvantages normally associated therewith.

Even still another object of the present invention is to provide a masonry project kit for building basements. This allows the user to finish a floor without leaving footprints.

Still yet another object of the present invention is to provide a masonry project kit for building basements. This makes it possible to lift equipment over a wall and lower it on the other side.

An additional object of the present invention is to provide a masonry project kit for building basements. This allows the user to hang a ladder from a wall.

A further object of the present invention is to provide a masonry project kit for building basements. This enables the user to adjust the height of the ladder.

Lastly, it is an object of the present invention to provide a new and improved masonry project kit for building basements.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
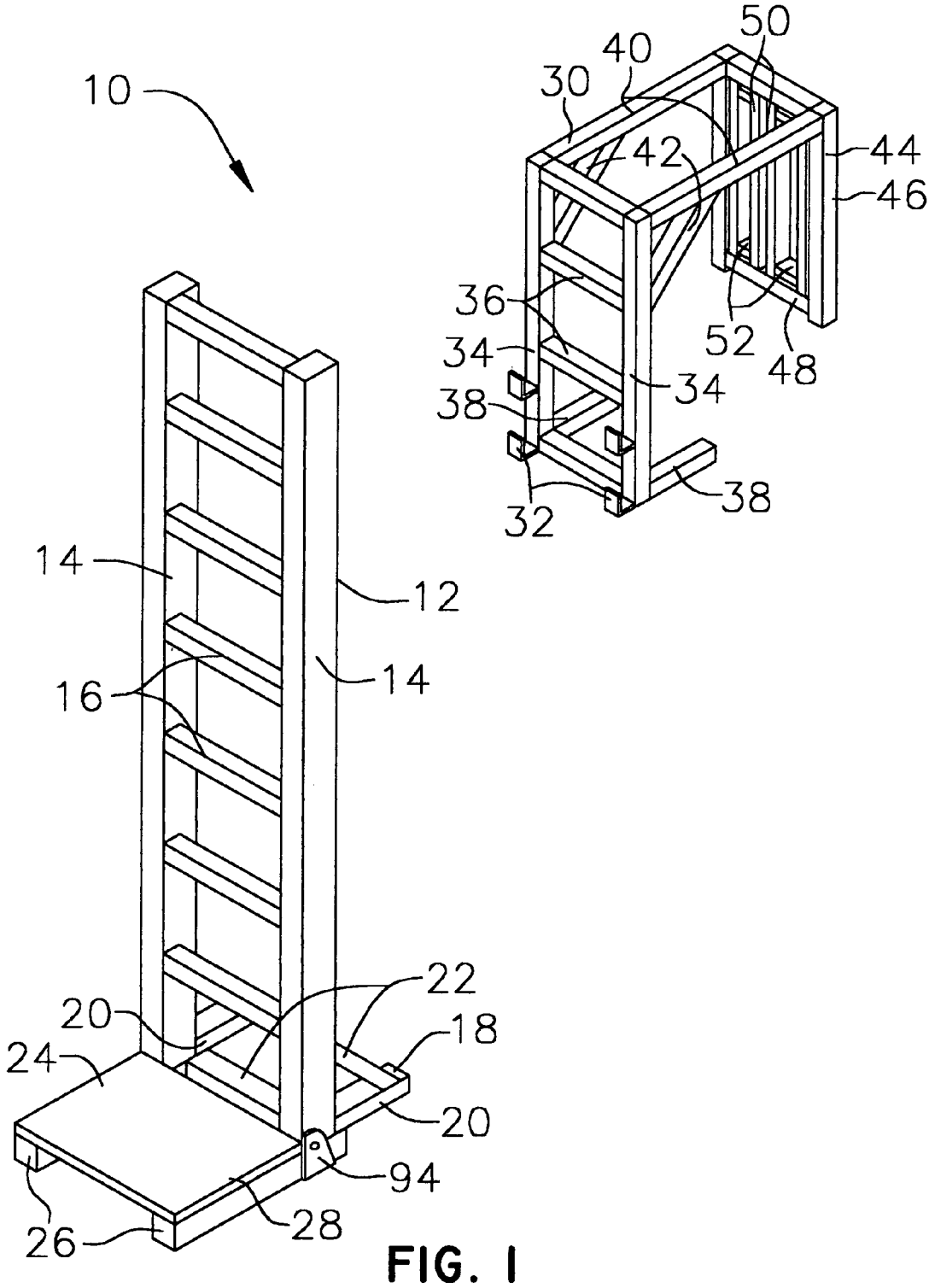
FIG. 1 is a top perspective view of the preferred embodiment of the masonry project kit constructed in accordance with the principles of the present invention.

Referring now to the drawings, and particularly to FIGS. 1–6, a preferred embodiment of the masonry project kit of the present invention is shown and generally designated by the reference numeral 10.

In FIG. 1, a new and improved masonry project kit 10 of the present invention for building basements is illustrated and will be described. More particularly, the masonry project kit 10 has a ladder 12 with rung supports 14 supporting rungs 16. Hinge 94 is attached to one end of rung supports 14 and allows platform 24 to flip up when it is not needed. Plate 28 and platform supports 26 comprise platform 24. Support brace 18 also is attached to one end of rung supports 14. Support brace 18 supports a load placed on platform 24 and comprises brace wall supports 20 and brace wall support cross members 22. Ladder 12 removably hangs from the ladder brackets 32 of wall hanger 30 by rungs 16. The height of ladder 12 can be adjusted by changing which rungs 16 are hung from ladder brackets 32. Ladder brackets 32 are attached to ladder bracket supports 34. Front wall hanger supports 38 attached to one end of ladder bracket supports 34 support the load applied to ladder brackets 32. Top wall hanger supports 40 are attached to the opposing end of ladder bracket supports 34. Side wall hanger supports 42 and front wall hanger support cross members 36 are attached to ladder bracket supports 34 and further reinforce ladder bracket supports 34. Rear hanger brace 44 is attached to the opposing end of top wall hanger supports 40. Rear hanger brace 44 comprises exterior rear brace supports 46, exterior rear brace support cross members 48, interior rear brace supports 50, and interior rear brace support cross members 52. Rear hanger brace 44 will be discussed in detail in the discussion of FIG. 3. The components of ladder 12 and wall hanger 30 are made of steel in the current embodiment.

Figure 2:
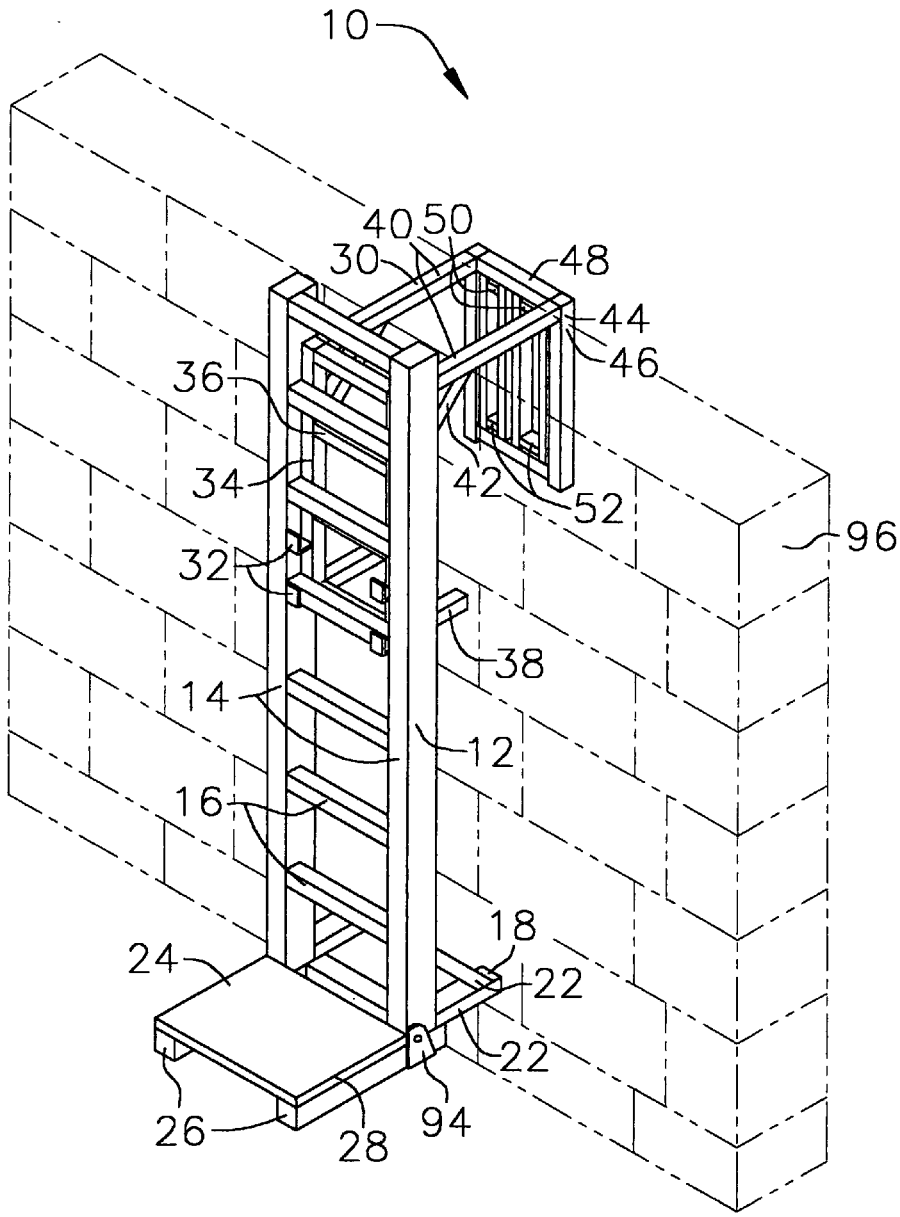
FIG. 2 is a top perspective view of the masonry project kit of the present invention.

Moving on to FIG. 2, a new and improved masonry project kit 10 of the present invention for building basements is illustrated and will be described. More particularly, the masonry project kit 10 is removably attached to wall 96. Ladder 12 is hanging from ladder brackets 32. The front wall hanger support 38 and the support brace 18 support ladder 12 and wall hanger 30 against the front face of wall 96. Top wall hanger supports 40 and side wall hanger supports 42 transfer the load of ladder 12 to the top of wall 96. Rear hanger brace 44 prevents wall hanger 30 from slipping off of the top of wall 96. Rung supports 14, rungs 16, brace wall support 20, brace wall support cross member 22, platform 24, platform supports 26, plate 28, ladder bracket support 34, front wall hanger support cross member 36, exterior rear brace support 46, exterior rear brace support cross member 48, interior rear brace supports 50, and interior rear brace support cross members 52 are also shown. In the current embodiment, wall hanger 30 accommodates walls 96 with widths of eight to twelve inches. Note that the broken lines illustrating wall 96 are for illustrative purposes only and are not part of the current invention.

Figure 3:
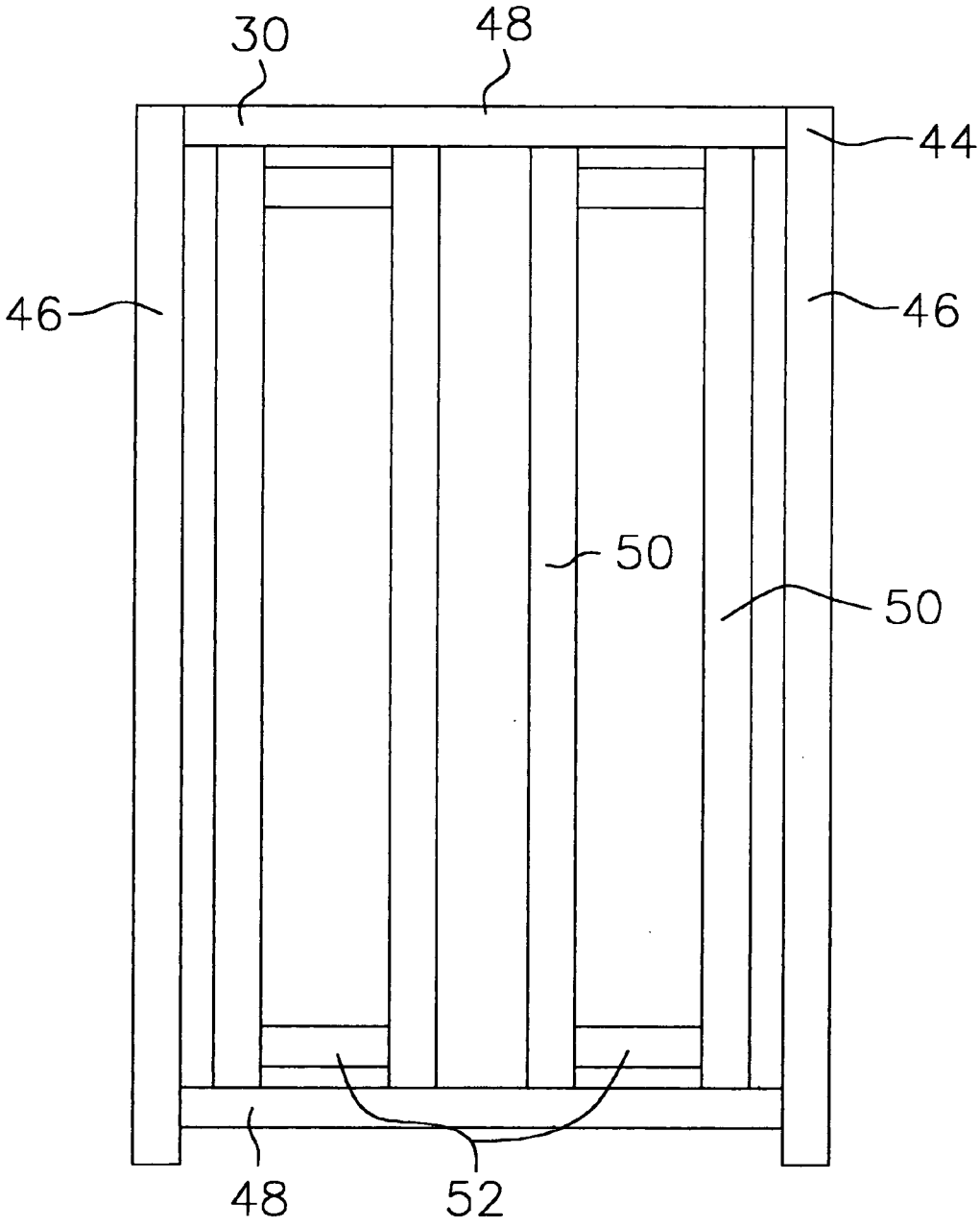
FIG. 3 is a rear side view of the wall hanger of the present invention.

Continuing with FIG. 3, a new and improved wall hanger 30 of the present invention for building basements is illustrated and will be described. More particularly, the wall hanger 30 has a rear hanger brace 44. Rear hanger brace 44 comprises exterior rear brace supports 46 with their ends connected by exterior rear brace support cross members 48. Rear hanger brace 44 also comprises interior rear brace support cross members 52 with their ends connected to exterior rear brace support cross members 48. The ends of interior rear brace supports 50 are connected by interior rear brace support cross members 52. The structure of rear hanger brace 44 ensures that wall hanger 30 will not slip off of the top of wall 96 (not shown).

Figure 4:
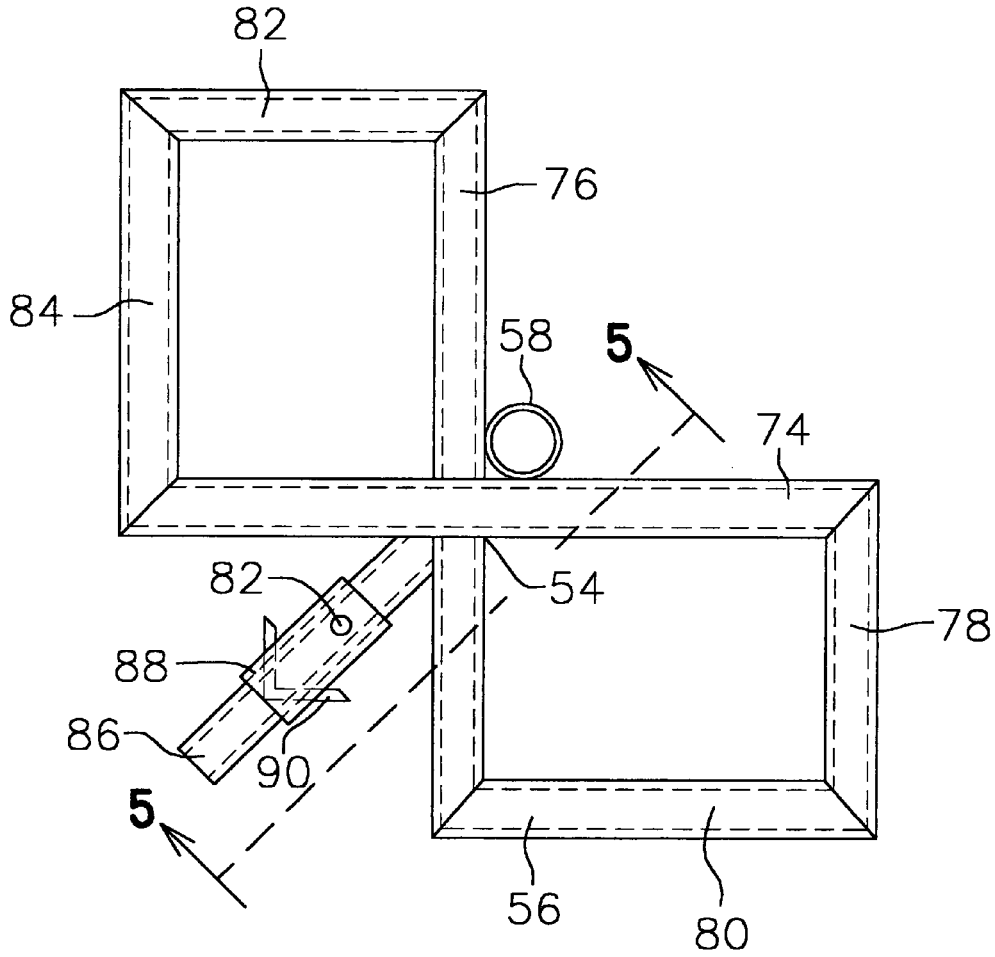
FIG. 4 is a top side view of the hoist of the present invention.

In FIG. 4, a new and improved hoist 54 of the present invention for building basements is illustrated and will be described. More particularly, the hoist 54 has a base 56. Base 56 has a first base support member 74 crossing over second base support member 76. Third base support member 78 has one end attached to one end of first base support member 74. Fourth base support member 80 has one end attached to the opposing end of third base support member 78 and the other end attached to one end of second base support member 76. Fifth base support member 82 has one end attached to the opposing end of second base support member 76. Sixth base support member 84 has one end attached to the opposing end of fifth base support member 82 and the opposing end attached to the opposing end of first base support member 74. Hoist tube fitting 58 has its sidewall attached to first base support member 74 and second base support member 76. Seventh base support member 86 is attached to the middle of base 56. Wall support adjuster 88 is slidably mounted on seventh base support member 86 and has wall support adjuster stop hole 92 in its top. Wall support 90 is attached to the underside of wall support adjuster 88. In the current embodiment, base 56, hoist tube fitting 58, seventh base support member 86, wall support adjuster 88, and wall support 90 are made of steel.

Figure 5:
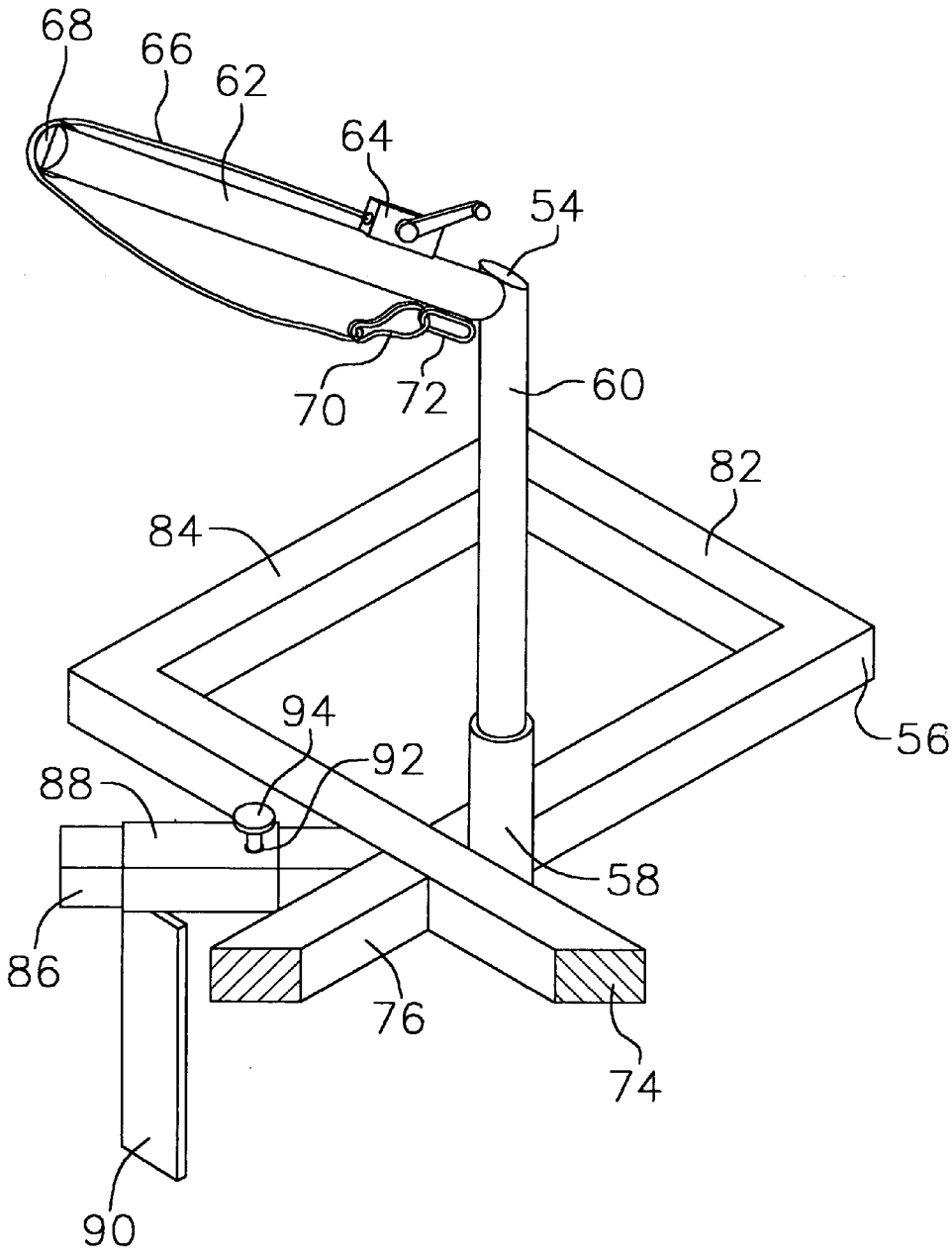
FIG. 5 is a top perspective sectional view of the hoist of the present invention.

Furthermore, in FIG. 5, a new and improved hoist 54 of the present invention for building basements is illustrated and will be described. More particularly, the hoist 54 has a base 56 with an attached hoist tube fitting 58. First hoist tube 60 has one end rotatably inserted into hoist tube fitting 58. Second hoist tube 62 has one end attached to the opposing end of first hoist tube 60 and a pulley 68 mounted on its opposing end. Winch 64 is mounted on the sidewall of second hoist tube 62. Lifting cable 66 has one end attached to winch 64 and the opposing end attached to clip 70. Clip 70 is removably connected to retaining ring 72 located on the sidewall of second hoist tube 62. First base support member 74, second base support member 76, fifth base support member 82, sixth base support member 84, seventh base support member 86, wall support adjuster 88, and wall support 90 are also shown. Wall support adjuster stop 94 is visible threadedly inserted into wall support adjuster stop hole 92. Wall support adjuster stop 94 locks wall support adjuster 88 in place when it is screwed down. In the current embodiment, first hoist tube 60, second hoist tube 62, pulley 68, clip 70, retaining ring 72, winch 64, and wall support adjuster stop 94 are made of steel. Lifting cable 66 is made of steel cable in the current embodiment.

Figure 6:
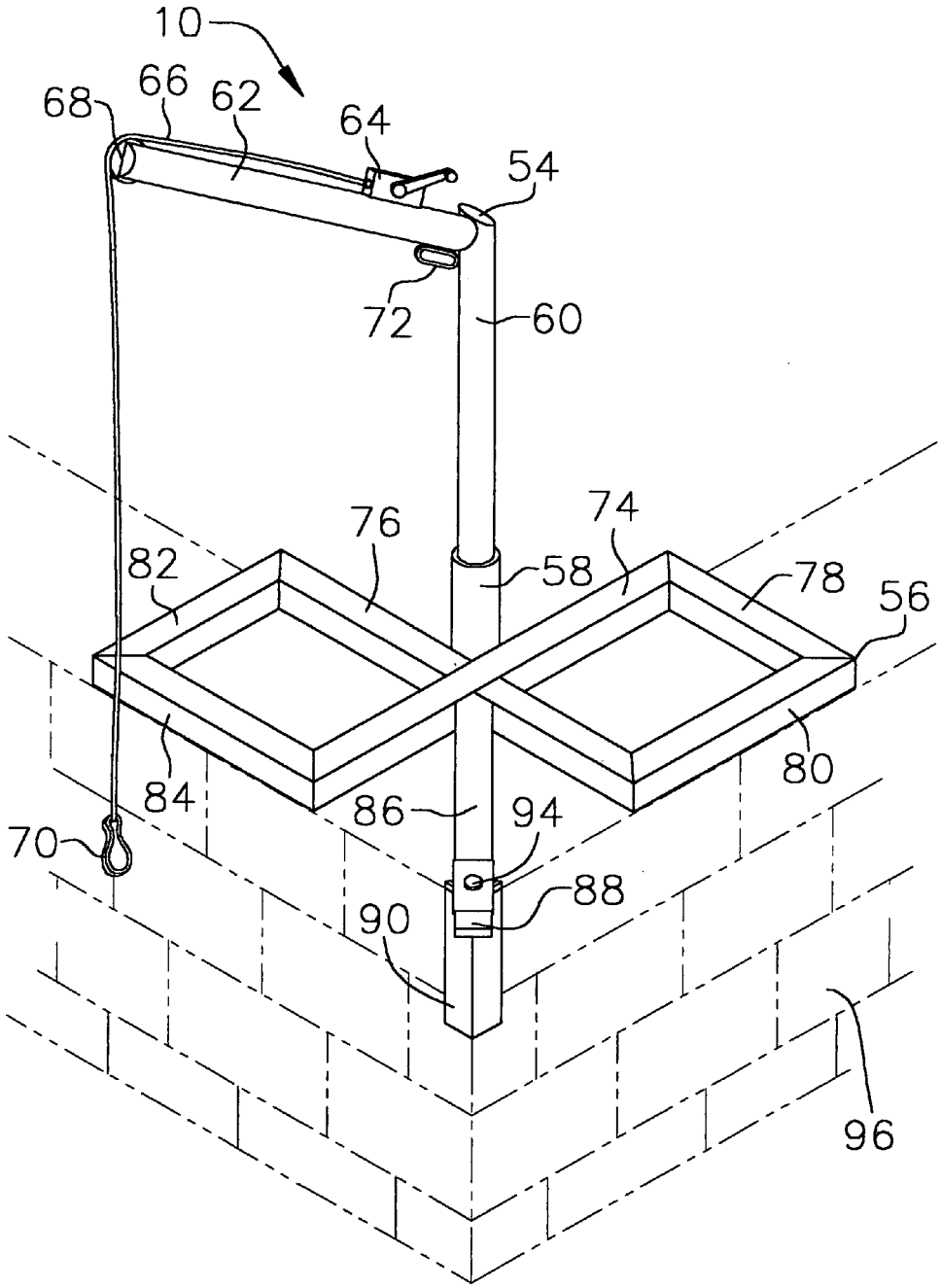
FIG. 6 is a top perspective view of the masonry project kit of the present invention.

Lastly, in FIG. 6, a new and improved masonry project kit 10 of the present invention for building basements is illustrated and will be described. More particularly, the masonry project kit 10 has a base 56 resting atop wall 96. Base 56 supports a load lifted by hoist 54. Wall support 90 engages a corner of wall 96, supporting base 56 by preventing it from sliding. Wall support adjuster 88 allows wall support 90 to be moved to fit a variety of wall 96 widths. A load to be lifted is removably connected to clip 70. Cranking winch 64 takes up lifting cable 66 and lifts clip 70. Pulley 68 rotates to guide lifting cable 66 over the end of second hoist tube 62 and keeps clip 70 away from wall 96. First hoist tube 60, retaining ring 72, hoist tube fitting 58, first base support member 74, second base support member 76, third base support member 78, fourth base support member 80, fifth base support member 82, sixth base support member 84, seventh base support member 86, and wall support adjuster stop 94 are also shown. Note that the broken lines illustrating wall 96 are for illustrative purposes only and are not part of the current invention.

In use, it can now be understood that wall hanger 30 is placed over the top of wall 96. The appropriate rungs 16 are hung on ladder brackets so that ladder 12 and platform 24 are at the appropriate height. Platform 24 is folded up and down as needed. Hoist 54 is mounted atop wall 96 by unscrewing wall support adjuster support 94, sliding wall support adjuster 88 until wall support 90 engages with a corner of wall 96, and screwing down wall support adjuster stop 94 to prevent wall support adjuster 88 from moving. First hoist tube 60 is rotated until clip 70 is above the load to be lifted. Clip 70 is then disengaged from retaining ring 72 and lowered by cranking winch 74. Clip 70 is attached to a load and then winch 64 is used to take up lifting cable 66, thereby lifting the load. First hoist tube 60 is rotated inside of hoist tube fitting 58 until clip 70 is above the desired resting place for the load. Winch 64 is then cranked to release lifting cable 66, thereby lowering clip 70. Clip 70 is then disengaged from the load, reattached to retaining ring 72, and any slack in lifting cable 66 is drawn over pulley 68 by cranking winch 64.

While a preferred embodiment of the masonry project kit has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic, aluminum, titanium, or carbon fiber composite may be used instead of the steel ladder, wall hanger, base, wall support, wall support adjuster, wall support adjuster stop, hoist tube fitting, first hoist tube, second hoist tube, winch, pulley, clip, and seventh base support member described. Also, the steel cable lifting cable may also be made of rope, wire, or chain. And although building basements has been described, it should be appreciated that the masonry project kit herein described is also suitable for numerous lifting, climbing, and building activities.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A masonry project kit comprising:

a ladder;

a wall hanger attached to said ladder; and a hoist, wherein said hoist comprises a base having a middle, wherein said base comprises a first base support member having opposing ends and a middle, a second base support member having opposing ends and a middle with said middle of said second brace support member connected to said middle of said first base support member, a third base support member having opposing ends with one end connected to one end of said first base support member, a fourth base support member having opposing ends with one end connected to said opposing end of said third base support member and said opposing end of said fourth base support member connected to one end of said second base support member, a fifth base support member having opposing ends with one end connected to said opposing end of said second base support member, a sixth base support member having opposing ends with one end connected to said opposing end of said first base support member and said opposing end of said sixth base support member connected to said opposing end of said fifth base support member, a seventh base support member having opposing ends with one end connected to said middle of said second base support member, a wall support adjuster having a top and a bottom slidably mounted on said seventh base support member, a wall support having opposing ends with one end attached to said bottom of said wall support adjuster, a wall support adjuster stop hole wherein said top of said wall support defines a hole therein to comprise said wall support adjuster stop hole, and a wall support adjuster stop threadedly inserted into said wall support adjuster stop hole;

a hoist tube fitting having a sidewall with said sidewall attached to said middle of said base;

a first hoist tube having opposing ends with one end inserted into said hoist tube fitting;

a second hoist tube having opposing ends and a sidewall with one end connected to said opposing end of said first hoist tube;

a pulley attached to said opposing end of said second hoist tube;

a winch attached to said sidewall of said second hoist tube; and a lifting cable having opposing ends with one end attached to said winch.

2. The masonry project kit as defined in claim 1, wherein said ladder comprises:

a rung support having opposing ends; and a rung attached to said rung support.

3. The masonry project kit as defined in claim 2, wherein said ladder further comprises a support brace attached to one end of said rung support.

4. The masonry project kit as defined in claim 2, wherein said ladder further comprises a platform attached to one end of said rung support.

5. The masonry project kit as defined in claim 3, wherein said support brace comprises:

a brace wall support having opposing ends with one end attached to one end of said rung support; and a brace wall support cross member attached to said brace wall support.

6. The masonry project kit as defined in claim 4, wherein said platform comprises:

a platform support having a top and opposing ends with one end hingedly attached to said one end of said rung support; and a plate connected to said top of said platform support.

7. The masonry project kit as defined in claim 1, wherein said wall hanger comprises:

a ladder bracket support having opposing ends;

a front wall hanger support having opposing ends and a middle with one end attached to one end of said ladder bracket support;

a front wall hanger support cross member attached to one end of said front wall hanger support;

a ladder bracket attached to said ladder bracket support;

a top wall hanger support having opposing ends and a middle with one end attached to said opposing end of said ladder bracket support;

a side hanger wall support having opposing ends with one end attached to said middle of said ladder bracket support and said opposing end attached to said middle of said top wall hanger support; and a rear hanger brace attached to said opposing end of said top hanger wall support.

8. The masonry project kit as defined in claim 7, wherein said rear hanger brace comprises:

an exterior rear brace support having opposing ends;

an exterior rear brace support cross member having opposing ends with one end attached to one end of said exterior rear brace support;

an interior rear brace support having opposing ends with one end attached to one end of said exterior rear brace support cross member; and an interior rear brace support cross member having opposing ends with one end attached to one end of said interior rear brace support.

9. The masonry project kit as defined in claim 1, wherein said hoist further comprises:

a clip connected to said opposing end of said lifting cable; and a retaining ring attached to said sidewall of said second hoist tube.

10. The masonry project kit as defined in claim 1, wherein said base is shaped like two rectangles perpendicular to one another with one overlapping corner.

11. The masonry project kit as defined in claim 1, wherein said wall support is V-shaped in cross-section.

12. The masonry project kit as defined in claim 1, wherein said ladder is selected from the group consisting of plastic, steel, aluminum, titanium, wood, and carbon fiber composite.

13. The masonry project kit as defined in claim 1, wherein said wall hanger is selected from the group consisting of plastic, steel, aluminum, titanium, wood, and carbon fiber composite.

14. The masonry project kit as defined in claim 1, wherein said base is selected from the group consisting of plastic, steel, aluminum, titanium, wood, and carbon fiber composite.

15. The masonry project kit as defined in claim 1, wherein said lifting cable is selected from the group consisting of rope, wire, chain, and cable.

* * * * *